US006979236B1

(12) United States Patent
Stanton

(10) Patent No.: US 6,979,236 B1
(45) Date of Patent: Dec. 27, 2005

(54) WEDGE CONNECTOR ASSEMBLY

(75) Inventor: Daniel J. Stanton, New Lenox, IL (US)

(73) Assignee: FCI Americas Technology, Inc., Reno, NV (US)

( * ) Notice: Subject to any disclaimer, the term of this patent is extended or adjusted under 35 U.S.C. 154(b) by 99 days.

(21) Appl. No.: 10/887,164

(22) Filed: Jul. 7, 2004

(51) Int. Cl.[7] ..... H01R 4/50
(52) U.S. Cl. ..... 439/783; 439/8; 439/807
(58) Field of Search ..... 439/783, 784, 439/863, 8, 807; 174/94 R, 94 S

(56) References Cited

U.S. PATENT DOCUMENTS

| | | | | | |
|---|---|---|---|---|---|
| 3,280,856 | A | * | 10/1966 | Broske et al. | 439/783 |
| 4,097,108 | A | | 6/1978 | Prodel | 439/475 |
| 4,153,322 | A | | 5/1979 | Godfrey | 339/95 R |
| 4,600,264 | A | | 7/1986 | Counsel | 339/247 |
| 4,730,087 | A | * | 3/1988 | Werner | 439/783 |
| 4,734,062 | A | * | 3/1988 | Goto | 439/783 |
| 4,857,020 | A | * | 8/1989 | Crosby | 439/783 |
| 4,934,949 | A | | 6/1990 | Charneski et al. | 439/387 |
| 5,092,797 | A | * | 3/1992 | Cole et al. | 439/783 |
| 5,340,335 | A | * | 8/1994 | Haun | 439/783 |
| 5,367,251 | A | | 11/1994 | McTigue | 324/133 |
| 5,423,699 | A | * | 6/1995 | Johnson | 439/783 |
| 5,507,671 | A | | 4/1996 | Chadbourne et al. | 439/783 |
| 5,547,404 | A | | 8/1996 | Nellis, Jr. et al. | 439/803 |
| 5,558,546 | A | | 9/1996 | Chadbourne et al. | 439/783 |
| 5,580,284 | A | * | 12/1996 | Laricchia | 439/783 |
| 5,613,883 | A | | 3/1997 | Chadbourne et al. | 439/783 |
| 5,679,031 | A | | 10/1997 | Chadbourne et al. | 439/783 |
| 5,794,334 | A | | 8/1998 | Chadbourne et al. | 29/876 |
| 5,816,865 | A | | 10/1998 | Chadbourne | 439/783 |
| 5,830,019 | A | | 11/1998 | Chadbourne et al. | 439/783 |
| 5,911,604 | A | | 6/1999 | Chadbourne | 439/783 |
| 5,916,001 | A | | 6/1999 | Chadbourne | 439/783 |
| 5,979,215 | A | | 11/1999 | Lefavour et al. | 72/453.16 |
| 6,309,261 | B1 | | 10/2001 | Chadbourne | 439/783 |
| 6,322,402 | B1 | | 11/2001 | Chadbourne et al. | 439/783 |

OTHER PUBLICATIONS

Tyco Electronics Product Catalog "AMPACT Stud Disconnect System", Apr. 2004, 2 pages.

* cited by examiner

*Primary Examiner*—Tho D. Ta
(74) *Attorney, Agent, or Firm*—Harrington & Smith, LLP

(57) ABSTRACT

In accordance with one aspect of the invention, an electrical wedge connector assembly is disclosed. The assembly comprises a shell, an eye bolt and a wedge sized and shaped to be inserted into the shell for connecting two conductors to each other. The eye bolt comprises a swivel joint adapted to be inserted into the wedge.

21 Claims, 5 Drawing Sheets

WEDGE CONNECTOR ASSEMBLY

BACKGROUND OF THE INVENTION

1. Field of the Invention

The present invention relates to electrical clamps and, more particularly, to a wedge connector assembly.

2. Background Information

U.S. Pat. No. 4,339,942 discloses an electric tap connector with a wedge that is moved into the shell by a bolt. U.S. Pat. No. 5,367,251 discloses a tool for grasping an electrical power conductor. The tool has a plurality of pointed pins mounted on a movable platform to pierce cable sheathing and insulation and contact a conductor of a cable held in place by the tool. U.S. Pat. No. 5,916,001 discloses a wedge connector with a shell and a wedge. The shell has insulation piercing sections to pierce through insulation of electrical conductor cables.

Despite the above advances, there is a desire for an improved wedge hot line clamp or wedge connector assembly suitable for connecting an overhead distribution current carrying conductor to another. The present invention addresses this need and others.

SUMMARY OF THE INVENTION

In accordance with one aspect of the present invention, an electrical wedge connector assembly is disclosed. The assembly comprises a shell, an eye bolt and a wedge sized and shaped to be inserted into the shell for connecting two conductors to each other. The eye bolt comprises a swivel joint adapted to be inserted into the wedge.

In accordance with another aspect of the present invention, an electrical wedge connector assembly is disclosed. The assembly comprises a shell, a wedge and an eye bolt. The shell is a one-piece member having a general "0" shaped cross-section and tapers from a first end to a more narrow second end. The wedge is sized and shaped to be inserted into the shell for connecting two conductors to each other. The eye bolt comprises a swivel joint adapted to be inserted into the wedge.

In accordance with a further aspect of the invention, a method of connecting two conductors using a wedge connector assembly is disclosed. The method comprises providing an electrical wedge connector. The wedge connector comprises a shell and a wedge sized and shaped to be inserted into the shell for connecting the two conductors to each other, wherein the shell comprises a protrusion having a first end and a second end. The method also comprises providing an eye bolt comprising a first end and second end and inserting the second end of the eye bolt through the protrusion so that the second end of the eye bolt extends from the second end of the protrusion. The method further comprises securing a first end of a swivel joint to the second end of the eye bolt and securing a second end of the swivel joint to the wedge; and rotating the eye bolt to position the wedge between the two conductors. Advantageously, the wedge rubs against the conductors creating a wiping action in which surface oxides are removed.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
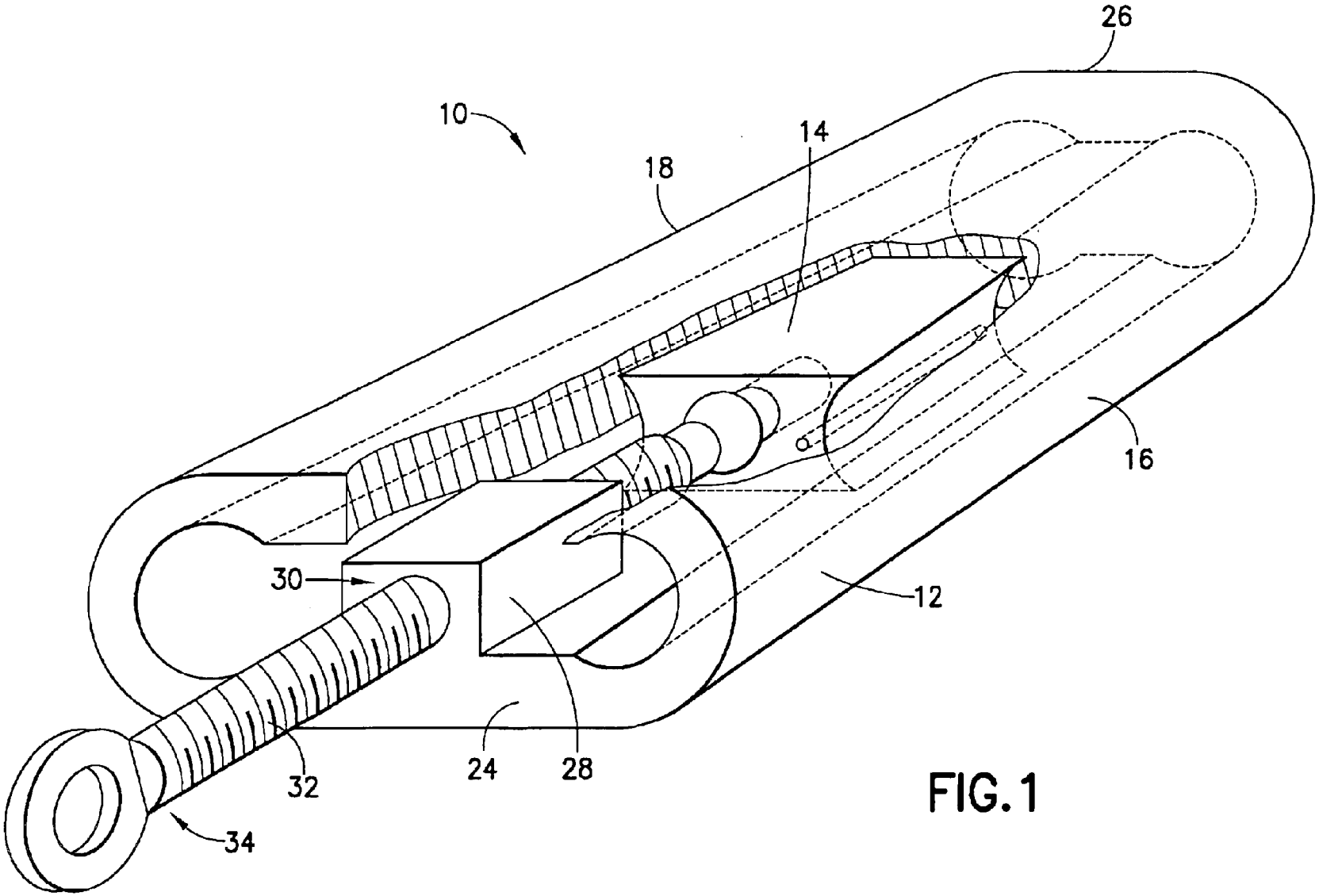
FIG. 1 is a perspective view an electrical wedge conductor assembly incorporating features of an embodiment of the invention.
Figure 2:
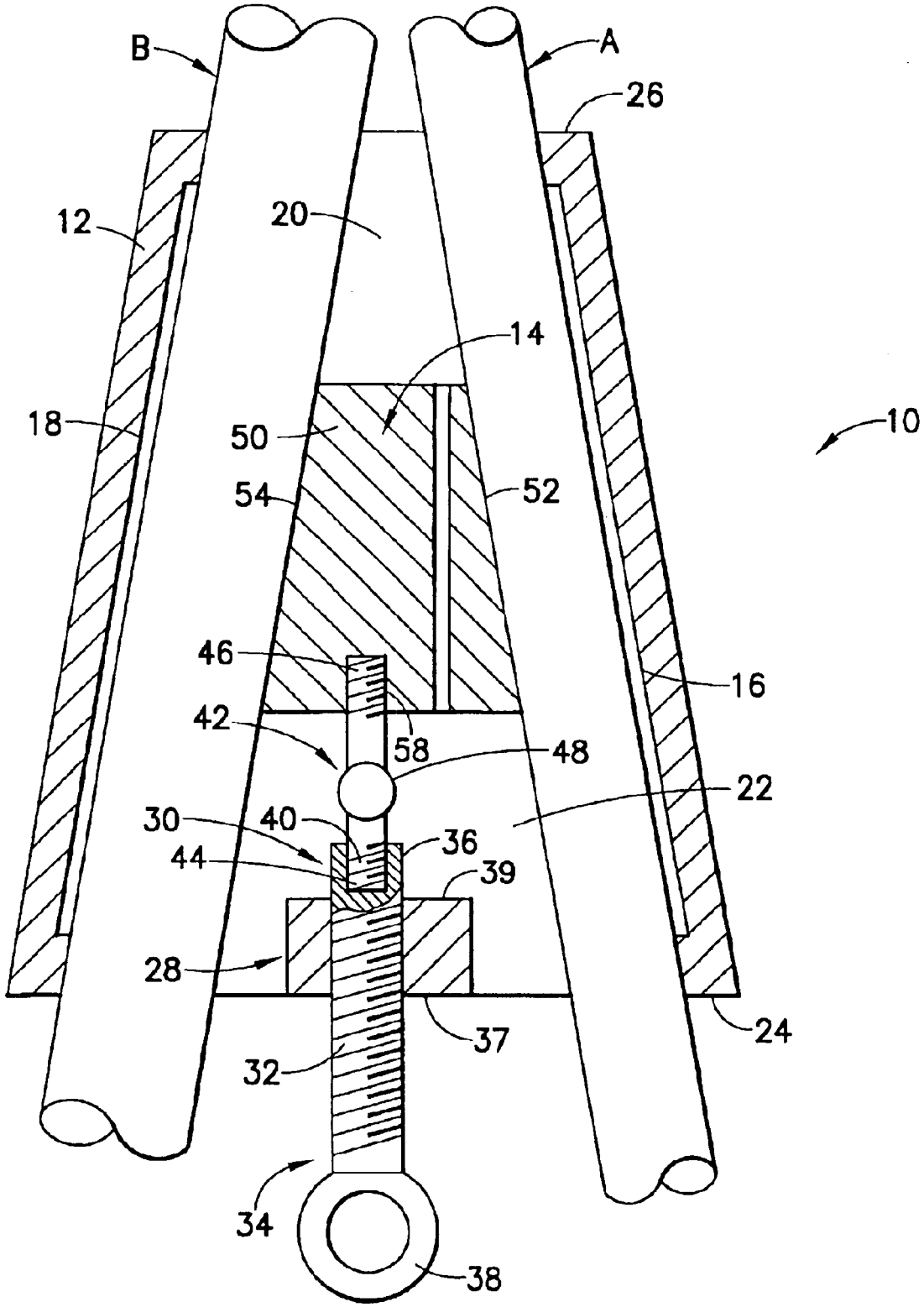
FIG. 2 is a cross-sectional view of FIG. 1, also showing cables A and B.

Referring to FIGS. 1 and 2, there is shown an electrical wedge connector assembly 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The wedge connector assembly 10 comprises a shell 12 and a wedge 14. The shell 12 is typically a one-piece member that may be made of any suitable material of significant strength to withhold the clamping forces during operation, including sheet metal. The shell 12 may also be a cast, drawn or extruded member. Preferably, shell 12 is a cast, copper body. The shell 12 has two opposing channel sections 16 and 18 interconnected by a middle section, or cavity 20 to form a general "0" or oval shape with a receiving area 22 for receiving the wedge 14 and the cables A, B. The "0" shape tapers from a first end 24 to a more narrow second end 26, as shown in FIG. 1. The thickness of the shell 12 may also be any suitable thickness capable of withstanding internal forces created by wedge 14 during operation, including electromechanical forces typically experienced during high fault current conditions.

Located at the first end 24 typical ly is a protrusion 28, which is preferably cast with the shell 12 as part of the one-piece member. The protrusion 28 may be of any suitable shape and size having a threaded aperture 30 therein through which an eye bolt 32 may be inserted. Preferably, the protrusion 28 is of a width larger that the diameter of the eye bolt 32, as shown in FIGS. 1–2 and 5, and cast in block form as a threaded block along with the casting of shell 12.

Figure 5:
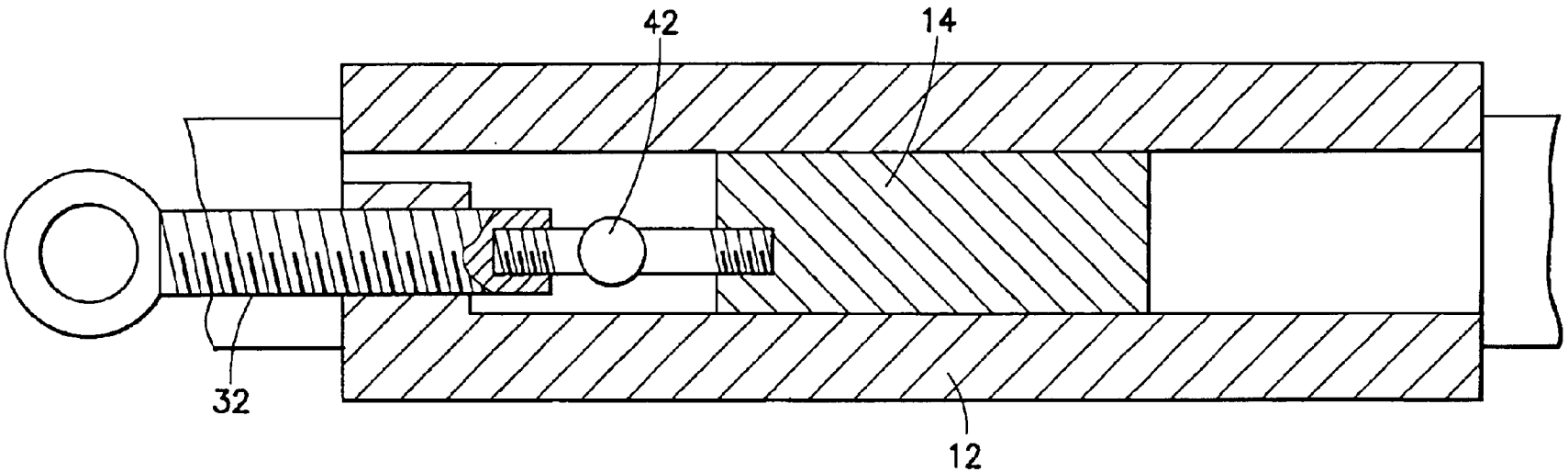
FIG. 5 shows view B of FIG. 4.

The eye bolt 32 has a first end 34, a second end 36 and a ring 38, as also shown in FIGS. 1–2 and 5. The ring 38 may be engaged by a suitable tool and turned during installation or removal of the wedge connector assembly 10. Preferably, the ring 38 is welded to the first end 34 of the eye bolt 32. Alternatively, the ring 38 may be forged and cast as a continuous piece of the eye bolt 32.

The second end 36 of the eye bolt 32 may be inserted into a first end 37 of the protrusion or threaded block 28 such that the second end 36 of the eye bolt 32 protrudes through a second end 39 of the protrusion, or threaded block 28, as shown in FIG. 2. The second end 36 of the eye bolt 32 also includes a threaded aperture 40 through which a swivel joint 42 may be inserted, as shown in FIG. 2. The swivel joint 42 may be made of any suitable material and is preferable made of a metal, such as steel. The swivel joint 42 includes a first end 44 and a second end 46, which are interconnected by a ball bearing mechanism 48 including a cup or socket and a ball. The ball may be snapped into the socket to create a joint in which the ball moves within the socket to allow rotary motion of the second end 46 of the swivel joint 42 at low coefficient friction. Advantageously, swivel joint 42 allows the forward motion of the wedge 14 during operation and provides a direct drive action as opposed to a worm drive mechanism of action. As the eye bolt 32 moves forward during operation friction is advantageously reduced. The negative effect of friction translates into lower contact force between cable A or tap conductor, wedge 14 and cable B or bail. Advantageously, the ball bearing mechanism 48, may have a lower coefficient property several times that of a rotating threaded rod on a fixed surface of similar material. The ball bearing mechanism 48 transfers greater torque into desired clamping forces by reducing friction.

The first end 44 of swivel joint 42 may be secured to the eye bolt 32 by insertion into the threaded aperture 40, as shown in FIGS. 1–2 and 5. The second end 46 of swivel joint 42 may be secured to the wedge 14, as described below. The first end 44 and the second end 46 are preferably in the form of threaded pins, or a rod.

The wedge 14 generally comprises a frame 50 and is preferably a one-piece copper member with two cable contact surfaces 52, 54. The wedge 14 preferably comprises a threaded aperture 58 into which the second end 46 of the swivel joint 42 may be inserted.

Figure 3:
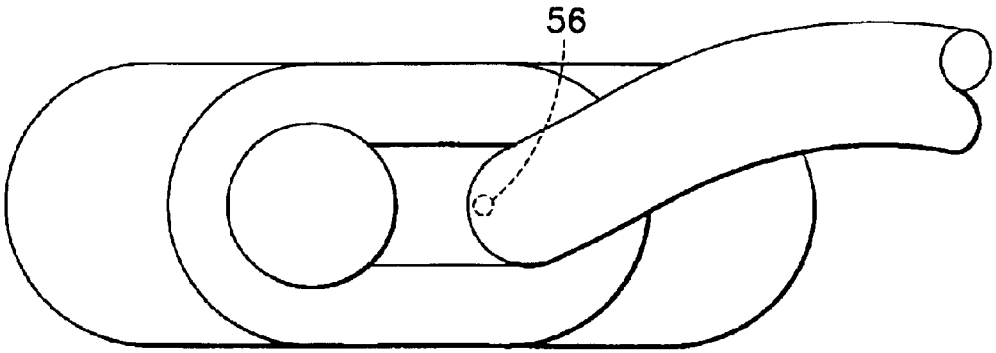
FIG. 3 is a top view of FIG. 2
Figure 4:
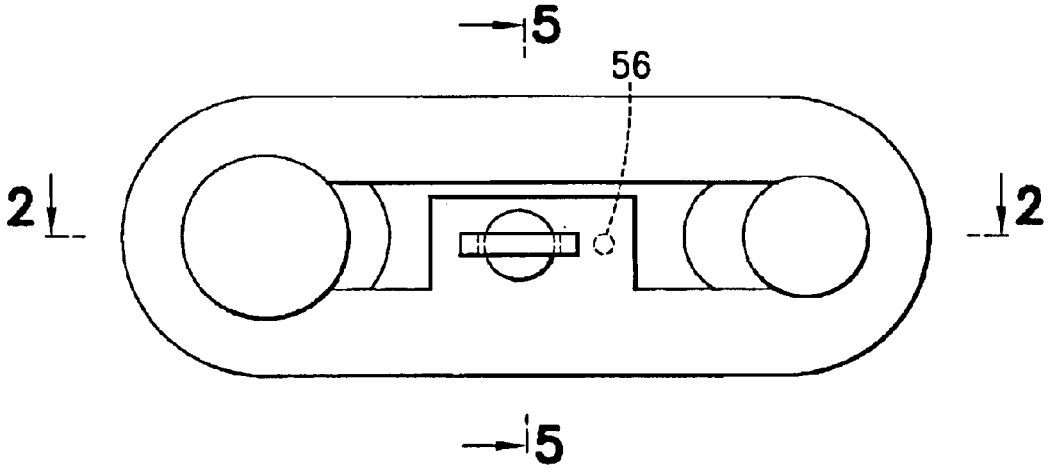
FIG. 4 is a bottom view of FIG. 2.

As shown in FIGS. 3–4, the wedge connector assembly 10 may also comprise a drain hole 56 preferably extending through the length of the wedge 14 for the draining of any residual water or fluid.

During operation, the wedge connector assembly 10 may be conventionally mounted on an elongated pole (not shown). Similarly, a non-conductive material may be used for turning of the eye bolt 32 by an operator working at a distance from an overhead cable. For example, an elongated pole of non-conductive material, such as glass fiber reinforced plastic, may be employed for manipulating the wedge connector assembly 10. The elongated pole typically has a retractable hook for engaging the ring 38 or eye. Rotation of the elongated pole serves to rotate the hook on the pole and to screw the eye bolt 32 typically upwards or downwards for positioning the wedge 14, which may also move in an upwards or downwards position, in the receiving area 22.

As also shown in FIGS. 1–2, the cable A or tap conductor, as well as cable B or bail, may be secured within shell 12 by placing the cables within shell 12 and tightening eye bolt 32 until the wedge 14 compresses against the opposing channel sections 16 and 18 of the shell. While the eye bolt 32 is being so tightened, the second end 46 of the swivel joint 42 transfers force into the wedge 14 to ensure a tight press-fit therewithin. Several turns of the eye bolt 32 may be all that is needed to ensure the desired clamping forces between cable A or tap conductor, the wedge 14, and cable B or bail. Eye bolt 32 may then be turned in the opposite direction to withdraw the fixed components of the wedge 14, steel swivel 42 with both ends 46 and 40. This will reduce the contact forces from cable A or tap conductor and cable B or bail. This will allow connector assembly 14 to be isolated from fixed cable B or bail.

Figure 6:
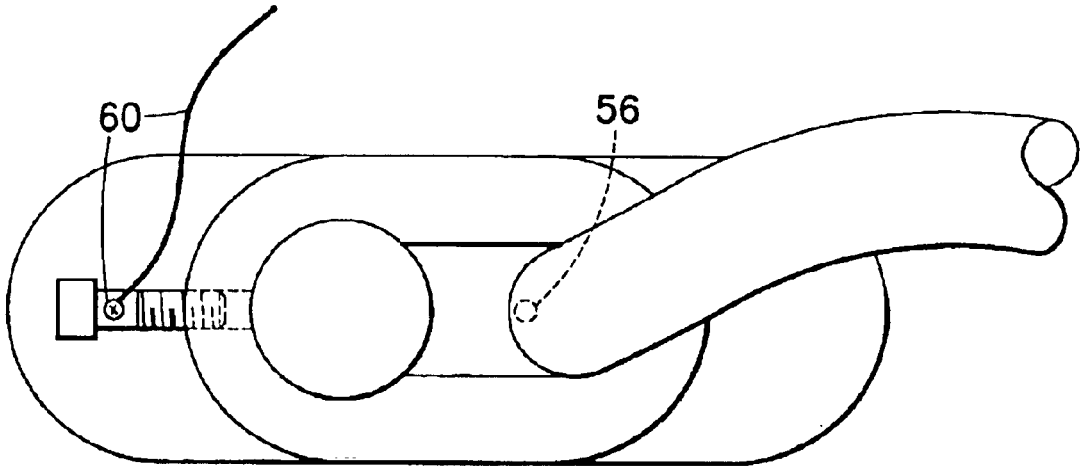
FIG. 6 shows a screw and wire assembly, in accordance with an embodiment of the invention.

The cable A or lead conductor may also be securely attached to the channel section 16 of the shell 12 by any suitable device prior to operation of the eye bolt 32. For example, as shown in FIG. 6, a screw and wire device 60 may be employed for securing the cable A to the shell 12. In particular, attached to outer shell 12 with use of a self tapping screw may be a flexible thin wire. The wire may be wrapped several times by the installer around cable A or tap conductor and continue back to the tap screw. Several additional wraps of the flexible thin wire around the tap screw may restrain or tightly secure cable A or tap conductor to connector assembly 10. This will allow the installer to approach the cable B or bail for connection with the connector assembly 10 and secured cable A or tap connector with use of the afore-mentioned elongated pole, in accordance with an embodiment of the invention.

The design of the wedge connector assembly 10 offers many advantages. For example, use of swivel joint 42 reduces friction and transfers more torque from the eye bolt 32 to the wedge 14 creating a greater clamping force. The eye bolt 32 also advantageously transfers torque from a hot stick or other conventional elongated pole through the swivel joint 42 to directly drive the wedge 14 tightly between the cables, such as a bail and lead wire or conductor.

Additionally, use of wedge 14 mechanically driven between the afore-described cables with use of swivel joint 42 provides oxide removing abrasion action or a wiping action on both of the cables. This is particularly advantageous when a copper cast wedge 14 is mechanically driven between a bail and lead conductor. Often, conductors must be wire brushed prior to application of a clamping mechanism to remove surface oxides. Surface oxides are known to increase electrical resistance at contacts points. Such oxide films may cause poor electrical contact and result in disadvantageous overheating. The afore-described wiping action provided by embodiments of the invention provides a much needed solution to a problem encountered with some prior clamping mechanisms.

Another advantage of embodiments of the invention is that Applicant's hot line clamp or wedge connector assembly may be used by operators to efficiently mechanically connect an overhead distribution current carrying conductor to another.

Further advantages of embodiments of the invention include use of a fully enclosed copper case housing or shell 12 that may produce secureness properties greater then a "C" shaped housing, which is advantageous during high mechanical stress periods created by fault current on the electrical distribution lines.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector assembly comprising:

a shell;

a wedge sized and shaped to be inserted into the shell for connecting two conductors to each other; and an eye bolt comprising a swivel joint to be inserted into the wedge.

2. The electrical wedge connector assembly of claim 1, wherein the swivel joint is made of steel.

3. The electrical connector wedge assembly of claim 1, wherein the shell is a one-piece cast copper body.

4. The electrical connector wedge assembly of claim 1, wherein the conductors comprise a bail and a lead conductor.

5. The electrical wedge connector assembly of claim 1, wherein the shell is a one-piece member having a general "0" shaped cross-section, wherein the shell tapers from a first end to a more narrow second end.

6. The electrical wedge connector assembly of claim 1, wherein the swivel joint includes a ball and socket.

7. The electrical wedge connector assembly of claim 6, wherein the swivel joint includes a first end and a second end, each formed as threaded pins and joined by the ball and socket.

8. The electrical wedge connector assembly of claim 7, wherein the shell is a one-piece member having a general "0" shaped cross-section, wherein the shell tapers from a first end to a more narrow second end.

9. The electrical wedge connector assembly of claim 8, wherein the shell comprises a protrusion including a threaded aperture and the eye bolt comprises a first end and a second end, wherein the second end of the eye bolt is adapted to be inserted into the threaded aperture.

10. The electrical connector wedge assembly of claim 9, wherein the protrusion is a threaded block of a width larger than the diameter of the eye bolt and cast along with the casting of the shell.

11. The electrical wedge connector assembly of claim 9, wherein the wedge is a one-piece metal member comprising a threaded aperture adapted to receive the second end of the swivel joint.

12. The electrical connector wedge assembly of claim 11, wherein the wedge comprises a drain hole.

13. An electrical wedge connector assembly comprising:

a shell, wherein the shell is a one-piece member having a general "0" shaped cross-section, wherein the shell tapers from a first end to a more narrow second end;

a wedge sized and shaped to be inserted into the shell for connecting two conductors to each other; and an eye bolt comprising a swivel joint adapted to be inserted into the wedge.

14. The electrical wedge connector assembly of claim 13 further comprising a screw and wire device.

15. A method of connecting two conductors using a wedge connector assembly, the method comprising:

providing an electrical wedge connector comprising a shell and a wedge sized and shaped to be inserted into the shell for connecting the two conductors to each other, wherein the shell comprises a protrusion having a first end and a second end;

providing an eye bolt comprising a first end and second end and inserting the second end of the eye bolt through the protrusion so that the second end of the eye bolt extends from the second end of the protrusion;

securing a first end of a swivel joint to the second end of the eye bolt and securing a second end of the swivel joint to the wedge; and rotating the eye bolt to position the wedge between the two conductors, wherein the wedge rubs against the conductors creating a wiping action in which surface oxides are removed.

16. The method of claim 15, comprising attaching an elongated pole to a ring located at the first end of the eye bolt.

17. The method of claim 15, wherein the protrusion is a threaded block.

18. The method of claim 15, comprising connecting a lead conductor to a bail.

19. An electrical wedge connector assembly comprising:

a shell;

a wedge sized and shaped to be inserted into the shell for connecting two conductors to each other; and a fastener adapted to be screwed into the wedge, wherein the fastener comprises a joint adapted to swivel.

20. An electrical wedge connector assembly comprising:

a shell, wherein the shell is a one-piece member having a general "0" shaped cross-section, wherein the shell tapers from a first end to a more narrow second end;

a wedge sized and shaped to be inserted into the shell for connecting two conductors to each other; and a screw fastener comprising a swivel joint adapted to be inserted into the wedge.

21. A method of connecting two conductors using a wedge connector assembly, the method comprising:

providing an electricla wedge connector comprising a shell and a wedge sized and shaped to be inserted into the shell for connecting the two conductors to each other, wherein the shell comprises a protrusion having a first end and a second end;

providing a screw fastener comprising a first end and second end and inserting the second end of the screw fastener through the protrusion so that the second end of the screw fastener extends from the second end of the protrusion;

securing a first end of a swivel joint to the second end of the screw fastener and securing a second end of the swivel joint to the wedge; and rotating the screw fasterner to position the wedge between the two conductors, wherein the wedge rubs against the conductors creating a wiping action in which surface oxides are removed.

* * * * *